US008499980B2

(12) United States Patent
Hagleitner

(10) Patent No.: US 8,499,980 B2
(45) Date of Patent: Aug. 6, 2013

(54) DISPENSER FOR A FLOWABLE MEDIUM HAVING A VALVED REMOVABLE CONTAINER FOR RECEIVING AN EXCHANGEABLE RESERVOIR

(76) Inventor: Hans Georg Hagleitner, Zell Am See (AT)

( * ) Notice: Subject to any disclaimer, the term of this patent is extended or adjusted under 35 U.S.C. 154(b) by 0 days.

(21) Appl. No.: 13/270,410

(22) Filed: Oct. 11, 2011

(65) Prior Publication Data

US 2012/0037659 A1 Feb. 16, 2012

Related U.S. Application Data

(63) Continuation of application No. PCT/AT2010/000041, filed on Feb. 12, 2010.

(30) Foreign Application Priority Data

Apr. 9, 2009 (AT) ..... A 557/2009

(51) Int. Cl.
*B67D 7/06* (2010.01)

(52) U.S. Cl.
USPC ..... 222/181.3; 222/325; 222/23; 222/39; 222/51

(58) Field of Classification Search
USPC ..... 222/23, 39, 51, 180–181.3, 182, 222/183, 325
See application file for complete search history.

(56) References Cited

U.S. PATENT DOCUMENTS

| | | | | |
|---|---|---|---|---|
| 3,369,706 | A | 2/1968 | Hagleitner | |
| 3,389,603 | A * | 6/1968 | Jacobs, III | 73/308 |
| 4,018,363 | A * | 4/1977 | Cassia | 222/80 |
| 4,036,406 | A * | 7/1977 | Jespersen et al. | 222/181.2 |
| 4,345,627 | A * | 8/1982 | Cassia | 141/18 |
| 4,391,308 | A * | 7/1983 | Steiner | 141/18 |
| 4,391,309 | A * | 7/1983 | Steiner | 141/18 |
| 4,429,812 | A * | 2/1984 | Steiner et al. | 222/181.2 |
| 4,570,823 | A | 2/1986 | Arabian et al. | |
| 4,576,313 | A * | 3/1986 | Smith et al. | 222/81 |
| 4,972,978 | A * | 11/1990 | DeLuca | 222/341 |
| 5,102,010 | A * | 4/1992 | Osgar et al. | 222/1 |
| 5,556,005 | A | 9/1996 | Banks | |
| 6,012,606 | A * | 1/2000 | Harris et al. | 222/51 |
| 6,237,807 | B1 * | 5/2001 | Uhl et al. | 222/39 |
| 6,758,372 | B2 * | 7/2004 | Studer et al. | 222/88 |
| 6,814,262 | B1 * | 11/2004 | Adams et al. | 222/214 |
| 2003/0071058 | A1 | 4/2003 | Studer et al. | |
| 2011/0101029 | A1 * | 5/2011 | Lewis et al. | 222/153.03 |

FOREIGN PATENT DOCUMENTS

| | | | |
|---|---|---|---|
| DE | 1528580 | B1 | 12/1971 |
| EP | 0023975 | A2 | 2/1981 |
| EP | 0116812 | A1 | 8/1984 |
| EP | 1118301 | A1 | 7/2001 |
| WO | 9621387 | A1 | 7/1996 |
| WO | 0152709 | A1 | 7/2001 |

* cited by examiner

*Primary Examiner* — Kevin P Shaver
*Assistant Examiner* — Patrick M Buechner
(74) *Attorney, Agent, or Firm* — Laurence A. Greenberg; Werner H. Stemer; Ralph E. Locher

(57) ABSTRACT

A dispenser for a flowable medium has a container with an outlet on the bottom. A pump is connected to the outlet. A replaceable reservoir is placed on top of the receptacle. The container is removably disposed within the dispenser base and includes a valve inside the outlet. The valve closes the outlet when the container is removed.

10 Claims, 2 Drawing Sheets

DISPENSER FOR A FLOWABLE MEDIUM HAVING A VALVED REMOVABLE CONTAINER FOR RECEIVING AN EXCHANGEABLE RESERVOIR

CROSS-REFERENCE TO RELATED APPLICATION

This application is a continuation, under 35 U.S.C. §120, of copending international patent application PCT/AT2010/000041, filed Feb. 12, 2010, which designated the United States; this application also claims the priority, under 35 U.S.C. §119, of Austrian patent application No. A 557/2009, filed Apr. 9, 2009; the prior applications are herewith incorporated by reference in their entirety.

BACKGROUND OF THE INVENTION

Field of the Invention

The invention relates to a dispenser for a flowable medium, having a housing, in which a container, which has an underside outlet and is provided on the upper side with a receptacle for an exchangeable reservoir, and a pump which is assigned to the outlet are arranged.

Dispensers of this type are already known in a multiplicity of embodiments and serve to discharge the medium which is contained in the reservoir in portions. If the reservoir runs low, only a certain quantity is still available in the container for discharging until the reservoir, for example a bottle or the like, has been exchanged. According to U.S. Pat. No. 4,570,823 and its counterpart European patent application EP 0 116 812 A1, the fact that the reservoir is used up is indicated by way of a float which detects the filling level in the container.

International patent application publication WO 2001/52709 describes a dispenser of the type which is mentioned in the introduction. It discloses an intermediate container, to the outlet of which a peristaltic pump is fixed nonpositively by means of a clamping flange. A removal of the intermediate container without the pump is not intended and is also not possible without the clamping flange or nonpositive connection being released. The discharging opening following the pump contains a valve which is always closed if the pump is not actuated. The intermediate container contains a valve at the inlet, which valve closes when the reservoir bottle is removed, in order to avoid dirt penetrating. In a simple way without dismantling, the intermediate container can be removed from the dispenser only with the pump.

Here, a flowable medium, or pourable medium, is understood as being liquid, pasty, gel-like, optionally also pulverulent compounds which can be delivered by way of a pump; they can be soaps, cleaning agents, disinfection agents, personal care products such as skin cream or toothpaste, but also foodstuffs, such as mustard or ketchup.

All these media tend to form deposits in regions within the container and the pump with low flow and/or which come into contact with air, which deposits should be removed from time to time, in order not to impair the function. For this purpose, the dispenser has to be dismantled and rinsed, whereupon the medium contained in the container is lost at least partially.

SUMMARY OF THE INVENTION

It is accordingly an object of the invention to provide a dispenser for a pourable medium which overcomes the above-mentioned disadvantages of the heretofore-known devices and methods of this general type and which provides for a dispenser in which dispenser maintenance, service and cleaning are facilitated and as little medium as possible is lost.

With the foregoing and other objects in view there is provided, in accordance with the invention, a dispenser for a flowable medium, comprising:

a housing;

a container disposed in the housing, the container having an underside formed with an outlet and an upper side formed with a receptacle for an exchangeable reservoir;

a dispenser base containing a pump assigned to the outlet, the container and the dispenser base together forming a functional unit and the container being removable from the dispenser base without removing the pump; and a valve disposed to close the outlet of the container when the container is removed from the dispenser base.

In other words, the objects of the invention are achieved by the fact that the container is arranged such that it can be removed from the dispenser without the pump, and a valve which closes when the the container is removed is provided in or at the outlet of the container.

In this way, if cleaning of the unit is imminent, the container can be removed from the dispenser, without the medium contained in it running out or dripping, since the valve closes the outlet opening. The container itself can likewise also be cleaned or emptied more easily, for example when the product in the reservoir is changed, in order to prevent mixing with a remnant in the container. It is also favorable for this purpose if the container outlet does not drip and does not contaminate the unit during removal.

In accordance with a preferred embodiment of the invention plug-in guide elements are provided between the container and the basic body of the housing, an inlet channel preferably leading to the pump through a hollow plug-in guide element which projects upright from the basic body and, when the container is inserted, protrudes into the container through the valve seat of the valve, which valve seat is arranged in the outlet. The valve body is therefore held up from the valve seat. The valve body is preferably a ball or a cone, it preferably being provided, furthermore, that the upper edge of the inlet channel has lateral recesses, on which upper edge the ball rests, in order that the medium can flow out of the container to the pump when the valve is open. In order to prevent undesired outflow in the open state, the outlet has a sealing ring in the lower region, which sealing ring seals with respect to the circumference of the inlet channel.

The top-side receptacle for the exchangeable reservoir is arranged, in particular, on a welded or removable cover of the container. The underside of the cover can form an abutment for the valve spring. A helical spring which is plugged onto a mandrel, which projects downward from the cover, and presses against the valve body is preferably suitable as valve spring. When the container is raised, first of all the valve body is laid into the valve seat and closes the container. During further raising, the inlet channel slides out of the sealing ring in the outlet.

In accordance with a further preferred embodiment, the container is assigned a device for detecting and displaying the filling level of the medium. The device can comprise, for example, a float which is provided in the medium and a viewing window in the container, with the result that the filling level can be read off. In one preferred embodiment which can be used, for example, in a dispenser with an electrically driven pump, it can be provided that the device for detecting the filling level has a float which is arranged in the container and is assigned a permanent magnet, a reed contact or Hall sensor which interacts with the permanent magnet being provided outside the container. An electric circuit can be closed and, for example, a visual and/or acoustic indicator can be activated via the reed contact or the Hall sensor.

Other features which are considered as characteristic for the invention are set forth in the appended claims.

Although the invention is illustrated and described herein as embodied in a dispenser for a flowable medium, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
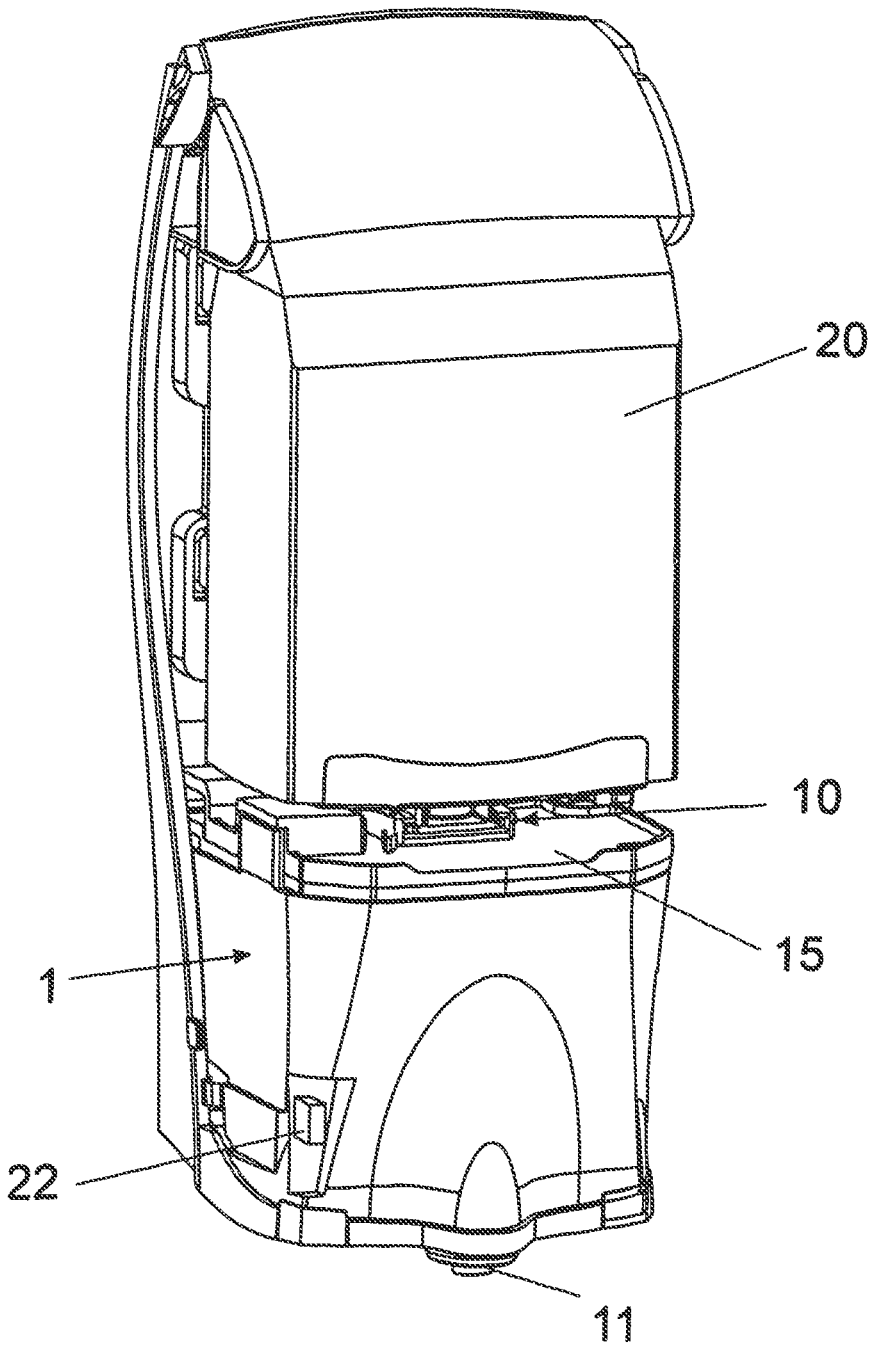
FIG. 1 is a front perspective view of a dispenser for soap or lather with its cover removed.

Referring now to the figures of the drawing in detail and first, particularly, to FIG. 1 thereof, there is shown a dispenser with a housing 1, in the upper region of which a reservoir 20 is inserted in an exchangeable manner into a liquid-tight receptacle 10. A compact working block, in which all of the functional elements are combined in a component unit, is provided in the lower region. The working block contains a container 3, from which a pump 17 sucks medium and discharges it through a metering opening 11. If the dispenser is provided for discharging soap, the working block can also, furthermore, contain an air pump which sucks in air and feeds it via an air line to a lathering device, in which it is mixed with the soap which is delivered by the soap pump. The pumps which are used preferably in each case have an electric drive, in particular a DC motor, the rotational speed of which is directly proportional to the motor voltage.

Figure 2:
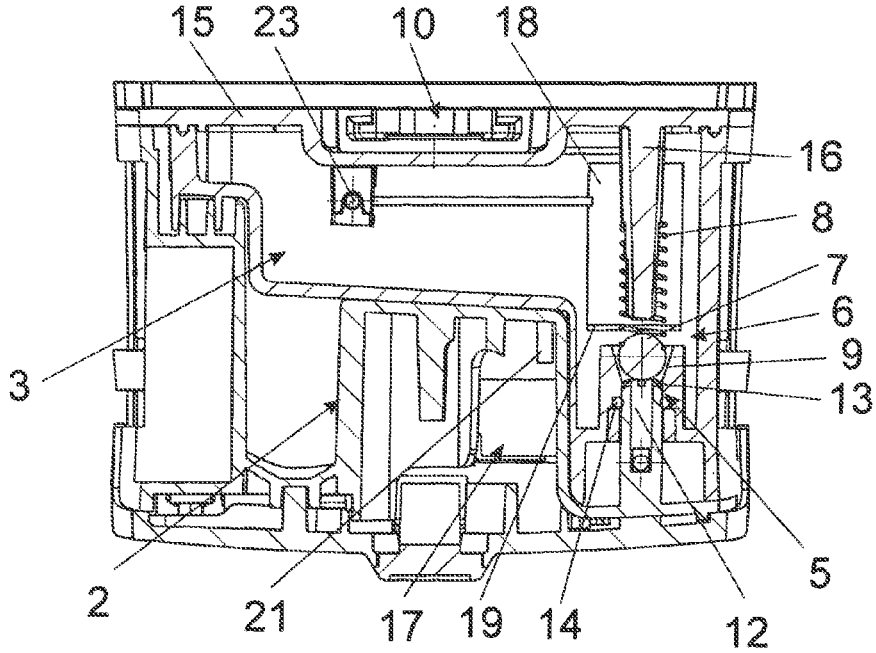
FIG. 2 is a vertical section taken through a lower part of the dispenser.
Figure 3:
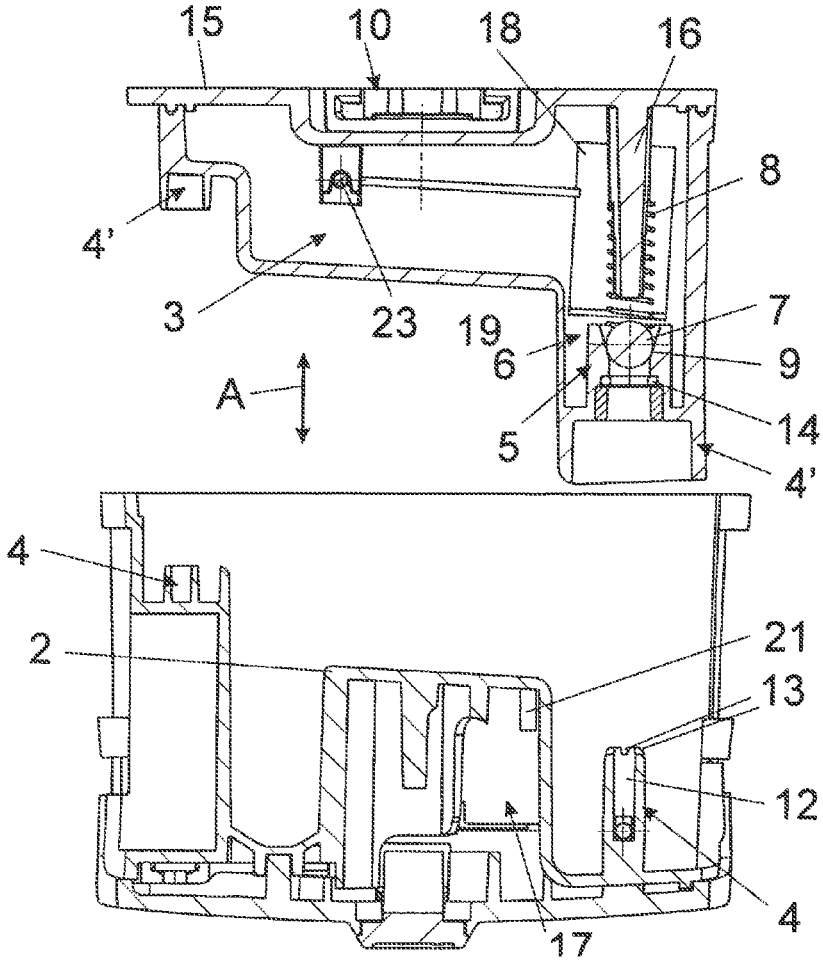
FIG. 3 is a vertical section through the lower part, with a container part partly removed from a dispenser base.

In detail, the vertical sections of FIGS. 2 and 3 show a basic body 2, also referred to as a dispenser base 2, from which pin-shaped or journal-shaped guide elements 4 project upright, one guide element 4 being hollow and being configured as an inlet channel 12 to the pump (not shown). The container 3 is provided with sleeve-shaped guide elements 4', with the result that it can be plugged from above onto the basic body 2 and can be removed upward from the basic body 2, as can be seen from FIG. 3 (arrow A). The container 3 has a cover 15, on which the receptacle 10 for the reservoir 20 is formed, the reservoir 20 preferably having a thin-walled plastic bag which is pushed from the front into the receptacle 10 in a sealing manner.

The medium which is contained flows into the container 3. The container 3 is provided at the lowest point with an outlet 5, through which, as FIG. 2 shows, the inlet channel 12 to the pump 17 projects into the interior of the container 3, a sealing ring 14 being provided for sealing the inlet channel 12. The pump 17 can therefore suck in medium and discharge it through the metering opening 11. In the dispenser which is shown for soap or lather, this preferably takes place in a contactless manner by a sensor system and controller (not shown); however, a mechanical actuation could likewise be provided via a lever or the like.

A mandrel 16 above the outlet 5 protrudes downward from the cover 15. A spring 8 is disposed on the mandrel 16. A valve 6 is provided in the outlet 5, which valve 6 has a valve body 7 which is stressed into the valve seat 9 by the spring 8. When the container 3 is place in the base body 2, and plugged on as shown in FIG. 2, the valve body 7 is seated on the upper edge of the inlet channel 12 which projects upright into the container 3, the spring 8 being compressed to a greater extent. Circumferential recesses 13 are formed on the upper edge of the inlet channel 12, in order that the valve body 7 does not prevent the medium flowing out of the container 3 to the pump 17 in this position.

If the container 3 is removed from the dispenser base 2, or basic body 2 (with or without reservoir)—indicated by the directional arrow A in FIG. 3—the inlet channel 12 slides downward in the outlet 5 of the reservoir 3 and the valve body 7 is pressed into the valve seat 9 which is formed in the outlet 5, with the result that no further medium can flow out and dripping is prevented. The inlet channel 12 leaves the sealing ring 14 in the outlet 5 only during further raising. The removed container 3 can have its remnants emptied, if desired, for example by the container being turned over, with the result that the remnants of the medium flow back into the reservoir which then hangs downward, and can be cleaned after removal of the reservoir and also exchanged in the case of damage. As soon as the container or a new container 3 is plugged on again, first of all the inlet channel 12 seals with respect to the outlet 5 via the annular seal 14, and subsequently the inlet channel 12 presses the valve body 7 upward again into the position according to FIG. 2.

Medium flows out of the reservoir 20 into the container 3 until it is used up. From this moment, only the medium which is contained in the container 3 is still available, with the result that the reservoir 20 can be replaced in the case of further discharging of medium. In order to indicate the reservoir 20 has been used up, the container 3 can have a front viewing window, through which the filling level of the medium can be seen directly. However, a float 18 on an arm which can be rotated about an axis 23 can also be provided in the container 3, as shown, which float 18 is assigned an indicator which can be seen from outside. If the dispenser is operated electrically and therefore contains an internal current source or is connected to an external current source, the filling level detection and its display can also take place using electric means. The bearing for the float 18 can likewise project downward from the cover 15. The float 18 can be fitted, for example, with a permanent magnet 19 which interacts contactlessly with an external reed contact 21, a Hall sensor or the like. The latter is provided, for example, on a control board, by which an external visual and/or acoustic indicator 22 (FIG. 1) can be actuated. The removal of the container 3 is not impeded by this contactless type of information transmission.

The invention claimed is:

1. A dispenser for a flowable medium, comprising:

a housing;

a container disposed in said housing, said container having an underside formed with an outlet and an upper side formed with a receptacle for an exchangeable reservoir;

a dispenser base having a pump, said pump being disposed within said dispenser base, said pump being assigned to said outlet, said container and said dispenser base together forming a functional unit and said container being removable from said dispenser base without removing said pump; and a valve disposed to close said outlet of said container when said container is removed from said dispenser base.

2. The dispenser according to claim 1, which comprises plug-in guide elements provided between said container and said dispenser base of said housing.

3. The dispenser according to claim 1, which comprises a device for determining and displaying a filling level of a medium in said container.

4. The dispenser according to claim 3, wherein said device for determining the filling level includes a float disposed in said container and a permanent magnet assigned to said float, and a reed contact disposed to interacts with said permanent magnet from outside said container.

5. The dispenser according to claim 3, wherein said device for determining the filling level is configured to activate a visual or acoustic empty state indicator when the filling level of the medium drops in the container.

6. A dispenser for a flowable medium, comprising:

a housing;

a container disposed in said housing, said container having an underside formed with an outlet and an upper side formed with a receptacle for an exchangeable reservoir;

a dispenser base containing a pump assigned to said outlet, said container and said dispenser base together forming a functional unit and said container being removable from said dispenser base without removing said pump;

a valve disposed to close said outlet of said container when said container is removed from said dispenser base; and an inlet channel leading to said pump being formed in a hollow plug-in guide element which projects upright from said dispenser base, and wherein, when said container is inserted, said inlet channel protrudes into said container through a valve seat of said valve formed in said outlet, and wherein a valve body is raised up from the valve seat.

7. The dispenser according to claim 6, wherein an upper edge of said inlet channel is formed with lateral recesses, and the upper edge is configured to support said valve body in the raised position.

8. A dispenser for a flowable medium, comprising:

a housing;

a container disposed in said housing, said container having an underside formed with an outlet and an upper side formed with a receptacle for an exchangeable reservoir;

a dispenser base containing a pump assigned to said outlet, said container and said dispenser base together forming a functional unit and said container being removable from said dispenser base without removing said pump; and a valve disposed to close said outlet of said container when said container is removed from said dispenser base;

said receptacle for the exchangeable reservoir being disposed on a cover of said container, and said cover having an underside with an abutment for a spring disposed to load a valve body of said valve.

9. The dispenser according to claim 8, wherein said abutment is a downwardly projecting mandrel.

10. The dispenser according to claim 9, wherein said valve body is a ball and said spring is a helical spring plugged onto said downwardly projecting mandrel.

* * * * *